US009347717B2

(12) United States Patent
Baruschke et al.

(10) Patent No.: US 9,347,717 B2
(45) Date of Patent: May 24, 2016

(54) METHOD FOR A CIRCUIT WITH HEAT ACCUMULATOR

(71) Applicant: Behr GmbH & Co. KG, Stuttgart (DE)

(72) Inventors: Wilhelm Baruschke, Wangen (DE); Thomas Strauss, Notzingen (DE); Rolf Müller, Steinheim (DE)

(73) Assignee: MAHLE International GmbH, Stuttgart (DE)

( * ) Notice: Subject to any disclaimer, the term of this patent is extended or adjusted under 35 U.S.C. 154(b) by 385 days.

(21) Appl. No.: 13/862,725

(22) Filed: Apr. 15, 2013

(65) Prior Publication Data

US 2013/0269925 A1 Oct. 17, 2013

(30) Foreign Application Priority Data

Apr. 13, 2012 (DE) ..... 10 2012 206 119

(51) Int. Cl.
*F28F 27/00* (2006.01)
*F01P 11/20* (2006.01)

(52) U.S. Cl.
CPC ..... *F28F 27/00* (2013.01); *F01P 11/20* (2013.01); *F01P 2011/205* (2013.01); *F01P 2025/30* (2013.01); *F01P 2025/50* (2013.01); *F01P 2037/02* (2013.01)

(58) Field of Classification Search
CPC ..... F01P 11/02; F01P 11/029; F01P 11/08; F01P 11/20; F28F 27/00; F28F 27/02
See application file for complete search history.

(56) References Cited

U.S. PATENT DOCUMENTS

| | | | | |
|---|---|---|---|---|
| 5,765,511 | A * | 6/1998 | Schatz | 123/41.14 |
| 5,809,944 | A | 9/1998 | Aoki et al. | |
| 5,896,833 | A | 4/1999 | Aoki et al. | |
| 2003/0200948 | A1 | 10/2003 | Ban et al. | |
| 2005/0229873 | A1 | 10/2005 | Willers | |

FOREIGN PATENT DOCUMENTS

| | | | |
|---|---|---|---|
| DE | 36 38 471 | A1 | 5/1987 |
| DE | 42 14 850 | A1 | 11/1993 |
| DE | 196 21 674 | A1 | 12/1997 |
| DE | 196 21 675 | A1 | 12/1997 |

(Continued)

OTHER PUBLICATIONS

German Search Report, DE 10 2012 206 119.3, Jul. 11, 2012, 5 pgs.

(Continued)

*Primary Examiner* — Lindsay Low
*Assistant Examiner* — Jacob Amick
(74) *Attorney, Agent, or Firm* — Paul D. Strain, Esq.; Strain & Strain PLLC

(57) ABSTRACT

The invention relates to a method for operating a circuit having a heat accumulator, having a coolant circuit, having a heat accumulator in a line of the circuit and having at least one valve and one pump, wherein, when the valve is open, the heat accumulator can be charged with coolant from the coolant circuit by means of the pump, or coolant can be discharged from the heat accumulator into the coolant circuit, wherein the charging or discharging of the heat accumulator takes place in an open-loop-controlled or closed-loop-controlled manner as a function of a temperature difference of a temperature of the coolant in the circuit and a temperature of the coolant in the heat accumulator.

14 Claims, 4 Drawing Sheets

(56) References Cited

FOREIGN PATENT DOCUMENTS

| | | | |
|---|---|---|---|
| DE | 197 36 222 | A1 | 3/1998 |
| DE | 197 37 818 | A1 | 3/1998 |
| DE | 197 21 756 | C1 | 8/1998 |
| DE | 198 18 030 | A1 | 10/1999 |
| DE | 102 34 608 | A1 | 2/2004 |
| DE | 103 44 018 | A1 | 6/2005 |
| EP | 1 199 206 | A2 | 4/2002 |
| EP | 2 143 573 | A1 | 1/2010 |
| JP | 2002-266679 | A | 9/2002 |
| JP | 2008-240734 | A | 10/2008 |

OTHER PUBLICATIONS

European Search Report, Appl. No. EP 13162995.8, Sep. 22, 2015, 6 pgs.

* cited by examiner

METHOD FOR A CIRCUIT WITH HEAT ACCUMULATOR

CROSS-REFERENCE TO RELATED PATENT APPLICATIONS

This application is based upon and claims the benefit of priority from prior German Patent Application No. 10 2012 206 119.3, filed Apr. 13, 2012, the entire contents of which are incorporated herein by reference in their entirety.

BACKGROUND

The invention relates to a method for operating a circuit having a heat accumulator, in particular as per the method for operating a circuit having a heat accumulator, having a coolant circuit, having a heat accumulator in a line of the circuit and having at least one valve and one pump, wherein, when the valve is open, the heat accumulator can be charged with coolant from the coolant circuit by means of the pump, or coolant can be discharged from the heat accumulator into the coolant circuit, wherein the charging or discharging of the heat accumulator takes place in an open-loop-controlled or closed-loop-controlled manner as a function of a temperature of the coolant in the circuit and/or a temperature of the coolant in the heat accumulator and/or a temperature difference therebetween and/or in a time-dependent manner.

In motor vehicles, the fuel consumption of an internal combustion engine is generally also dependent on the operating temperature of the internal combustion engine, or the temperature of the coolant. Here, the operating temperature of the coolant is generally between 80° C. and 110° C. In the time taken for the operating temperature to be reached, also referred to as the warm-up phase, the fuel consumption is, for various reasons, increased in relation to the fuel consumption when the engine is at operating temperature. One reason for this is the increased friction of all the moving parts of the internal combustion engine itself, and the friction of the components of the entire drivetrain of the motor vehicle. The initially cold combustion environment in the cylinder head however also adversely influences the fuel consumption.

The heat energy stored in the mass of the engine during the operation of the internal combustion engine, which heat energy is at a very high temperature level, is lost during the time period in which the internal combustion engine is shut down. Here, the main effect responsible for the heat energy loss is free convection.

One known measure is the provision of a heat accumulator in which thermal energy is stored in the form of warm liquid which can be supplied to the circuit again when required.

DE 103 44 018 A1 describes a method for the filling and emptying of a device for storing hot cooling liquid for the purpose of shortening the warm-up phase of an internal combustion engine. Here, all of the coolant from the circuit is pumped into a hot-water accumulator and stored there, wherein the coolant is pumped back into the circuit when required. As a result of the improved thermal insulation in the hot-water accumulator, the coolant does not cool down as quickly, such that it can be pumped back into the circuit in a warmer state than it would be in if it remained in the circuit. This leads to a faster warm-up of the internal combustion engine, such that the warm-up phase is reduced. Here, however, the energy stored in the mass of the engine is lost and is not available for a later engine start or warm-up and thus for a possible reduction of the time of the warm-up. It is thus necessary for fuel to be expended again for the warm-up, and increased fuel consumption is encountered during the warm-up phase.

In the method specified in DE 103 44 018 A1, an exchange of the fluid between the internal combustion engine and heat accumulator is provided. As a result of the extraction for example of the coolant from the engine, problems arise with regard to corrosion in the coolant jacket of the engine. Also, upon the starting of the engine, relatively fast refilling of the engine is required in order to avoid local component overheating. The ventilation, required for this purpose, of the engine coolant jacket is not solved.

The problem addressed by the invention is that of providing a method for operating a circuit having a heat accumulator, which ensures an improved yield of the thermal energy of the coolant than in the prior art. Here, it is particularly advantageous for the duration of the warm-up of the internal combustion engine to be further reduced in order to be able to operate the internal combustion engine more efficiently and, in the process, reduce fuel consumption and wear.

This is achieved by means of the features of a method for operating a circuit having a heat accumulator, having a coolant circuit, having a heat accumulator in a line of the circuit and having at least one valve and one pump, wherein, when the valve is open, the heat accumulator can be charged with coolant from the coolant circuit by means of the pump, or coolant can be discharged from the heat accumulator into the coolant circuit, wherein the charging or discharging of the heat accumulator takes place in an open-loop-controlled or closed-loop-controlled manner as a function of a temperature of the coolant in the circuit and/or a temperature of the coolant in the heat accumulator and/or a temperature difference therebetween and/or in a time-dependent manner.

A method according to the invention advantageously provides a method for operating a circuit having a heat accumulator, having a coolant circuit, having a heat accumulator in a line of the circuit and having at least one valve and one pump, wherein, when the valve is open, the heat accumulator can be charged with coolant from the coolant circuit by means of the pump, or coolant can be discharged from the heat accumulator into the coolant circuit, wherein the charging or discharging of the heat accumulator takes place in an open-loop-controlled or closed-loop-controlled manner as a function of a temperature of the coolant in the circuit and/or a temperature of the coolant in the heat accumulator and/or a temperature difference therebetween and/or in a time-dependent manner.

Here, it is advantageous for the temperature of the coolant in the coolant circuit to be a coolant temperature in the internal combustion engine or at the inlet or outlet of the internal combustion engine.

It is also advantageous for the temperature of the coolant in the heat accumulator to be a coolant temperature in the heat accumulator or at the inlet or outlet of the heat accumulator.

According to the invention, it is expedient for discharging of the heat accumulator into the cooling circuit to take place when the temperature of the coolant in the heat accumulator exceeds the temperature of the coolant in the cooling circuit by a first predefinable value.

It is also advantageous for discharging of the heat accumulator into the cooling circuit to take place in a time-dependent manner in a predefinable chronological sequence, or in a manner dependent on the most recent charging process and/or on the coolant temperature in the circuit.

It is also advantageous for the discharging of the heat accumulator into the cooling circuit to be ended when the temperature of the coolant in the heat accumulator exceeds the temperature of the coolant in the cooling circuit by less than a second predefinable value.

It is advantageous for discharging of the heat accumulator to take place only once or multiple times per driving cycle. If only one discharge is permitted per cycle, it is achieved that the coolant temperature is at its highest at the end of a driving cycle. If discharging is performed multiple times in the cycle, the coolant temperature can be optimized during the cycle.

It is also expedient for charging of the heat accumulator from the cooling circuit to take place when the temperature of the coolant in the cooling circuit exceeds the temperature of the coolant in the heat accumulator by a first predefinable value or the temperature of the coolant has reached a first predefinable value and/or in a time-dependent manner.

It is also advantageous for the temperature of the predefinable value to increase from one charging process to the next, preferably by 5 K or 10 K after each charging process.

It is also advantageous for the charging of the heat accumulator from the cooling circuit to be ended when the temperature of the coolant in the cooling circuit exceeds the temperature of the coolant in the heat accumulator by less than a second predefinable value or a predefinable time duration for the charging process has expired.

It is furthermore expedient for the charging of the heat accumulator from the cooling circuit to be ended when the temperature of the coolant in the cooling circuit exceeds the temperature of the coolant in the heat accumulator by less than a second predefinable value or a predefinable time duration for the charging process has expired.

It is also advantageous for charging of the heat accumulator to take place only when the coolant temperature in the cooling circuit has exceeded a predefinable threshold value. The threshold value is advantageously 60° C. or higher.

It is also advantageous for charging of the heat accumulator to take place as a function of the temperature difference of the coolant temperature in the cooling circuit minus the temperature of the coolant in the heat accumulator or as a function of the absolute value of the temperature of the coolant in the cooling circuit, wherein the charging also takes place multiple times per driving cycle. Here, open-loop control may be performed as a function of the temperature, such that activation takes place at predefinable temperatures, such as for example 60° C., 70° C., 80° C., 90° C., etc. It is also possible for smaller or greater temperature intervals to be selected, such as 60° C., 65° C., 70° C., etc, or 60° C., 75° C., 90° C., etc. It is for example possible for 60° C. to be selected as a starting value and for further charging to then take place at the starting value plus $\Delta T$, where $\Delta T$=5° C., 7.5° C., 10° C. or 15° C. or more.

It is also advantageous for no discharging of the heat accumulator to take place in overrun operation phases of the internal combustion engine of the vehicle.

By means of the method according to the invention, it is possible to achieve a reduction of the $CO_2$ emissions and a reduction in fuel consumption.

As a result of the pre-heating of the internal combustion engine, specifically of the cylinder head or of the combustion chamber, a decrease in $CO_2$ emissions is achieved as a result of the reduced heat dissipation into the internal combustion engine owing to the thermal mass and as a result of the reduction of friction losses.

It is also possible to achieve a reduction of untreated emissions during a cold start. As a result of a pre-heated combustion chamber, less untreated emissions (HC, CO, NOx, . . . ) are generated during a cold start of the engine.

It is also possible to attain an increase in comfort. The stored thermal energy permits a more spontaneous response of the vehicle heating arrangement, and an increased heating power as a result of the temperature increase during the warm-up phase. In vehicles with a start-stop function, stop phases can be bridged without a loss of heating comfort. Further advantageous refinements are described in the following description of the figures and in the subclaims.

BRIEF DESCRIPTION OF THE DRAWINGS

The invention will be explained in more detail below on the basis of at least one exemplary embodiment and with reference to the drawings, in which.

DETAILED DESCRIPTION OF PREFERRED EMBODIMENTS

Figure 1:
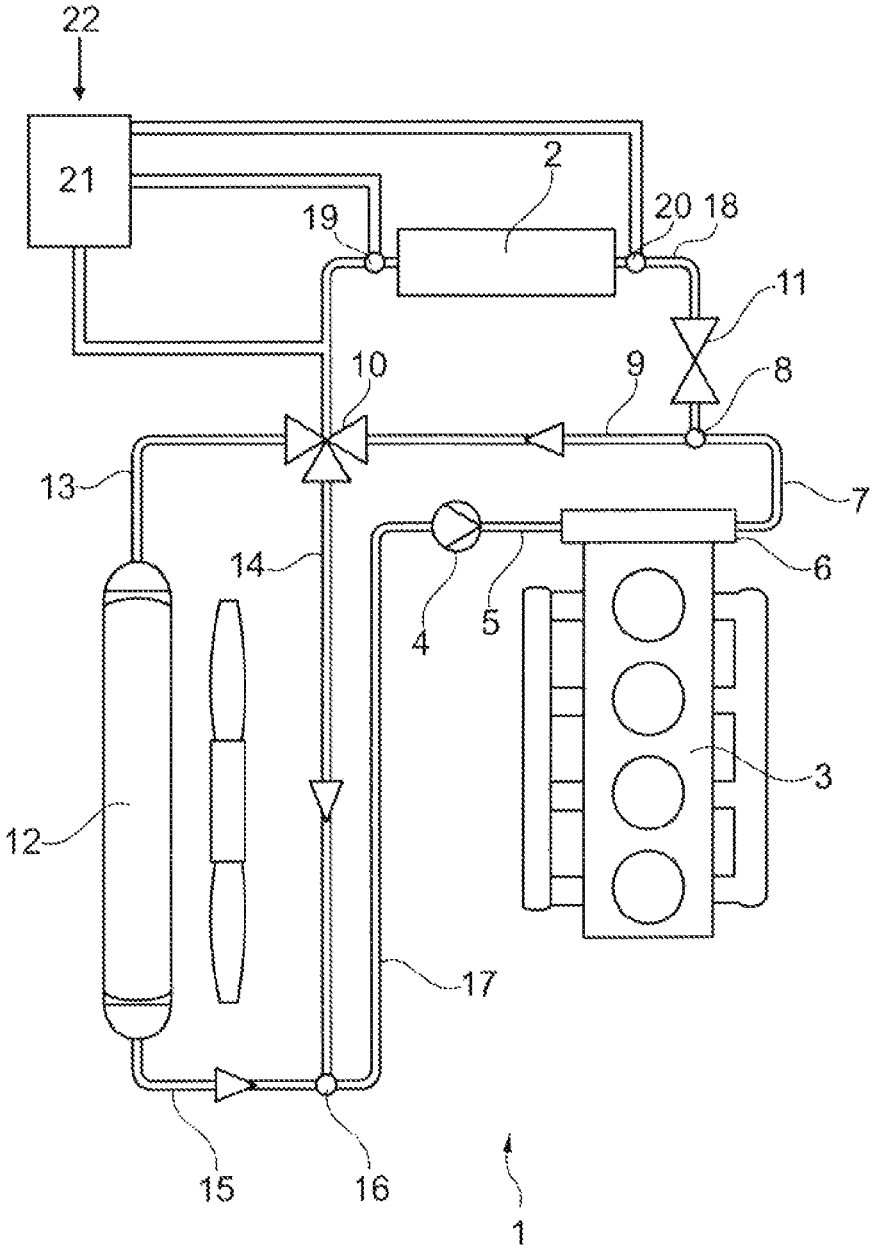
FIG. 1 is a circuit diagram showing the connection of a heat accumulator in a cooling circuit of an internal combustion engine.

FIG. 1 shows a first exemplary embodiment of a circuit 1 for a method for operating a circuit 1 having a heat accumulator 2. Here, the internal combustion engine 3 is connected in to a coolant circuit, wherein a pump 4 pumps a coolant through the line 5 to the internal combustion engine 3. The coolant flows through the internal combustion engine 3 and subsequently flows out of the internal combustion engine 3 at the outlet 6 and flows through the line 7. At the branch 8, the coolant can flow either via the line 9 to the thermostat valve 10 or to the valve 11.

If the coolant flows through the line 9 to the thermostat 10, said thermostat 10 can perform the distribution of the coolant either to the coolant cooler 12 via line 13 or to the bypass 14. Downstream of the coolant cooler 12, the coolant flows again through the line 15 to the merging point 16 with the bypass 14, and from there through the line 17 back to the pump 4.

If the valve 11 is open, coolant can also flow into the heat accumulator 2. This preferably takes place when the thermostat 10 closes the line 9. The coolant stored in the heat accumulator can also be pumped out of said accumulator again when the line 14 is opened by the thermostat and the pump 4 then pumps the coolant out.

Here, FIG. 1 shows a device in particular also for an open-loop or closed-loop control method for the efficient use of the heat quantity stored by means of the coolant in a heat accumulator.

FIG. 1 illustrates the connection of the heat accumulator 2 into a coolant circuit of an internal combustion engine 3 in particular of a motor vehicle. Coolant can flow through the heat accumulator 2 by virtue of the valve 11 being opened. The coolant volume flow is affected by means of a pump 4. The return of the coolant from the heat accumulator 2 into the cooling circuit may take place for example via the housing of the regulating thermostat 10 which can be used as a switching element. When the valve 11 is closed again, the coolant no longer circulates via the heat accumulator.

For efficient operation of a heat accumulator 2, it is advantageous for the thermodynamic characteristics thereof and/or the thermodynamic characteristics of the cooling circuit 1 to be taken into consideration. Furthermore, it is advantageous for the effects of the heat accumulator 2 on the cooling circuit 1 and/or the effects of the cooling circuit 1 on the heat accumulator 2 to be taken into consideration in a suitable manner.

For open-loop or closed-loop control, a unit 21 is provided which receives and processes the sensor signals from the temperature sensors 19, 20 at the inlet and/or outlet of the heat accumulator 2 in order to activate the valves 10, 11 and, if appropriate, activate the pump 4. The open-loop control unit 21 can also receive external signals 22, such as a temperature of the coolant in the internal combustion engine, via a data bus or in some other way.

Here, an operating method for the heat accumulator 2 in a cooling circuit 1 can advantageously be divided into phases, wherein said operating method can advantageously be divided into three phases. In other exemplary embodiments, the definition and number of the phases may also differ.

A first phase is the charging phase:

in the charging phase, warm or hot coolant is stored in the heat accumulator 2.

A first charging process is started when a minimum coolant temperature Tmin, which is optionally a function of the ambient temperature Tmin=f(Toutside), is reached in the cooling circuit 1 or in the internal combustion engine 2. For this purpose, coolant is preferably pumped or conducted by means of the pump 4 into the heat accumulator 2 via the open valve 11. That is to say, up to a certain coolant temperature Tmin, flow does not pass through the coolant path 18 in which the heat accumulator 2 is arranged. The valve 11 is opened only at temperatures above Tmin, that is to say when the minimum coolant temperature required has been reached.

The charging process, that is to say the filling of the heat accumulator 2 with at least warm coolant, may preferably be open-loop-controlled in a time-dependent manner. The charging may also be closed-loop-controlled in a temperature-dependent manner. For the open-loop control or closed-loop control of the charging, it is therefore advantageous in any case for the coolant temperature of the internal combustion engine to be known. Said coolant temperature can preferably be measured by means of a sensor or read out from open-loop control units which have already detected or determined said temperature or to which data are provided via a data bus, for example the CAN bus.

The time-dependent charging of the heat accumulator takes place as a function of the fill volume of the heat accumulator $V_{WSP}$ plus the dead volume $V_{dead}$ in the hoses and also as a function of the coolant volume flow per unit of time into the heat accumulator. Since the physical relationships between coolant volume and coolant volume flow change only slightly with coolant temperature and ambient temperature, the charging process can be performed on the basis of only one item of temperature information. The item of temperature information regarding the coolant temperature may be used from a coolant temperature sensor for example of the internal combustion engine.

Here, the following definitions apply:

$T_{KM}$ is the coolant temperature (of the internal combustion engine).

$t_{Charging}$ is the charging time, that is to say the time taken for the heat accumulator to be completely charged starting from an unfilled heat accumulator.

$V_{Total}=V_{WSP}+V_{dead}$–total volume=volume of the heat accumulator+dead volume (hoses)

To store the highest possible coolant temperature in the heat accumulator, the charging process is repeated when predefined temperature levels are reached. For example, the charging process may take place when further temperature intervals T=Tmin+ΔT are reached, wherein ΔT may for example be a predefinable value of 5 K, 7.5 K or 10 K, until the operating temperature of the internal combustion engine and thus the operating temperature $T_{Operating}$ of the coolant has been reached. Here, Tmin is advantageously 60° C. or higher.

Furthermore when a predefinable average speed of the vehicle is undershot, the frequency of the charging may be increased, such that for example ΔT is reduced from 10 K to 5 K or from 5 K to 3 K. This results in more frequent charging of the heat accumulator 2.

For a charging of the heat accumulator in the closed-loop control method, the charging may however also be performed in a temperature-dependent manner as a function of the coolant temperature $T_{KM}$.

The start signal for the charging comes from the coolant temperature $T_{KM}$ of the internal combustion engine. The charging process starts when the coolant temperature in the heat accumulator $T_{WSP}$ lies in a predefinable range of for example 5 K to 10 K below the coolant temperature $T_{KM}$ of the internal combustion engine.

The charging process continues until the temperature difference between the coolant entering and exiting the heat accumulator falls below a predefinable threshold value of for example 3 K.

To store the highest possible coolant temperature $T_{WSP}$ in the heat accumulator, the charging process is started again as a function of the most recently encountered coolant temperature $T_{KM}$ with a defined hysteresis, that is to say a temperature offset ($T_{Offset}$). For example, for the activation of the next charging process, a coolant temperature may have been reached which is 6K higher than that in the case of the most recent charging process. This means that, if the most recent charging process took place at $T_{KM}$=70° C., the next charging process will take place at $T_{KM}$=76° C. This is however expedient only when the coolant temperature is rising. This can be identified if the gradient of the coolant temperature is evaluated as a time-dependent function.

The charging process is ended when the temperature difference between the inlet temperature and the outlet temperature falls below the threshold value $T_{Threshold}$ of for example 3 K. The charging process is repeated until the operating temperature $T_{Operating}$ of the internal combustion engine reaches a predefinable value in the range from 80 to 110° C.

$T_{KM}$=coolant temperature (internal combustion engine)

$$\Delta T_{KM\ WSP}=T_{KM\ WSP}-T_{KM\ WSPA}$$

This means that the difference in temperature in the heat accumulator is the difference of the coolant temperature at the heat accumulator inlet minus the coolant temperature at the heat accumulator outlet.

A second phase is the discharging:

During the discharging, warm or hot coolant is discharged from the heat accumulator 2 into the cooling circuit 1.

During a driving cycle, it is advantageously the case that only one discharging process is performed, said discharging process being carried out, in the open-loop-controlled version, in a time-dependent and if appropriate time-dependent and parameterizable manner. Here, time-dependent and parameterizable means that the time dependency can be varied by means of parameters.

In the closed-loop-controlled method variant, the discharging may take place in a temperature-dependent manner.

A first discharging process is started when the coolant temperature of the cooling circuit or of the internal combustion engine is considerably lower than the coolant temperature in the heat accumulator.

The time-dependent discharging takes place as a function of the fill volume of the coolant volume, which is to be exchanged, of the respective cooling circuit, as a function of the available coolant volume of the heat accumulator, and as a function of the coolant volume flow. Since the physical relationships between coolant volume and coolant volume flow vary only slightly with coolant temperature and ambient temperature, the discharging process can be performed in a time-dependent manner on the basis of only one item of temperature information.

A first discharging process is started when the coolant temperature of the cooling circuit or of the internal combustion engine is considerably lower than the coolant temperature prevailing in the heat accumulator. Here, a required temperature difference of for example 5 K to 10 K may be taken as a basis.

The first discharging process of the heat accumulator preferably takes place before the starting of the internal combustion engine after a relatively long standstill period t>x h, where x is in the range from 0.5 to 24, has taken place.

It is thus possible for complete preheating of the cooling circuit and of the internal combustion engine to be achieved, and thus for the maximum advantage to be attained. The discharging process may for example take place already upon the unlocking of the vehicle or during a corresponding initialization by means of a vehicle key or the like. The discharging process ends when the temperature difference between the coolant outlet temperature at the heat accumulator and the coolant temperature of the internal combustion engine is lower than a predefinable value, such as for example 3 K.

The third phase is a neutral phase:

After the time functions of the closed-loop control expire or after the charging or discharging temperature conditions for the open-loop control are attained, a mode switch takes place into the neutral mode in which the accumulator is separated from the rest of the cooling circuit, that is to say is neither charged nor discharged.

Figure 2:
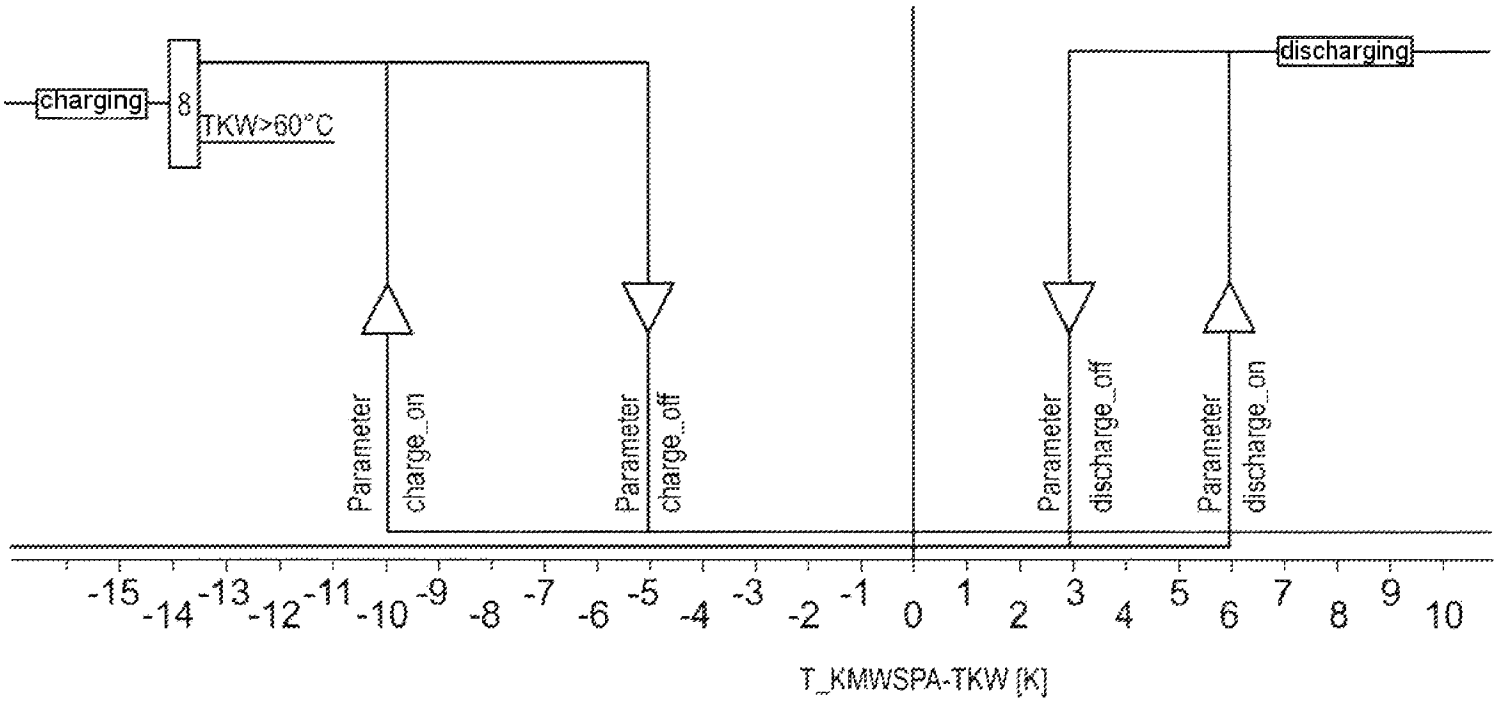
FIG. 2 shows a diagram.

FIG. 2 shows a diagram in which a temperature difference is plotted on the X axis. The temperature difference is the temperature of the coolant at the heat accumulator outlet minus the temperature of the coolant in the internal combustion engine. For the charging of the heat accumulator, in this regard see the left-hand half of the figure, it is queried as a condition as to whether the temperature of the coolant is higher than 60° C. and whether the difference between the coolant temperature at the heat accumulator outlet and the coolant temperature at the internal combustion engine is less than −10 K, which means that the coolant temperature of the internal combustion engine is more than 10 K higher than the temperature of the coolant at the heat accumulator outlet. In this case, the charging of the heat accumulator is activated. The charging of the heat accumulator is ended when the difference between the coolant temperature at the heat accumulator outlet and the coolant temperature of the internal combustion engine rises above −5 K in the direction of 0 K. This means that the magnitude of the difference is less than 5 K. In this case, the charging is ended. Here, −10 K and −5 K are examples of two predefinable threshold values for the starting and ending of the charging. Other values may also be used, such as for example 6 K and 3 K.

Discharging of the heat accumulator takes place when the difference of the temperature of the coolant at the heat accumulator outlet is more than 6 K higher than the temperature of the coolant in the internal combustion engine, and the discharging of heat accumulator is ended when the temperature of the coolant at the heat accumulator outlet is less than 3 K higher than the coolant temperature at the internal combustion engine. Here, 6 K and 3 K are examples of two predefinable threshold values for the starting and ending of the discharging. Other values may also be used, such as for example 10 K and 5 K.

In this way, a hysteresis is defined in each case for the charging and discharging, which is highly advantageous for the closed-loop control of the method.

Figure 3:
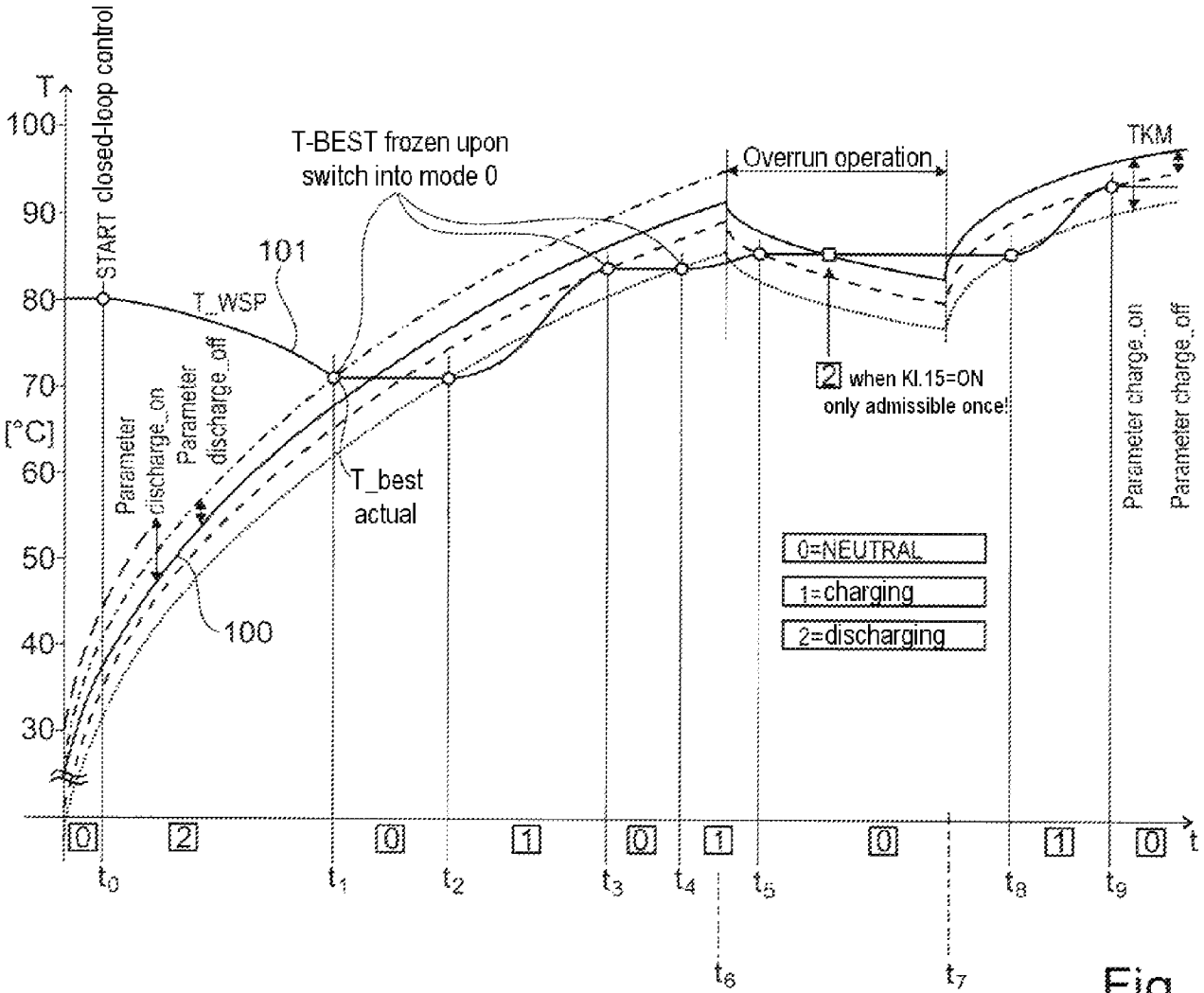
FIG. 3 shows a diagram.

FIG. 3 shows a diagram in which the temperature is plotted as a function of the time, wherein only time blocks are illustrated on the X axis.

FIG. 3 shows a curve 100 as a function of the time, wherein the curve 100 describes the coolant temperature in the internal combustion engine. Also illustrated is a curve 101 which defines the temperature of the coolant in the heat accumulator. As can be seen, at the start of the time scale, the coolant temperature in the internal combustion engine is very low, that is to say approximately 30° C. or lower, and the temperature in the heat accumulator is approximately 80° C. At the time t0, the closed-loop control of the heat accumulator starts, and a phase of discharging of the heat accumulator takes place from the time t0 to the time t1. At the time t0, the temperature of the coolant in the heat accumulator is approximately 40 K higher, such that discharging of the heat accumulator takes place in a closed-loop-controlled fashion. At the time t1, the temperature of the coolant at the heat accumulator outlet is only 3K higher than the temperature of the coolant in the internal combustion engine, for which reason the discharging of the heat accumulator is ended at the time t1. From the time t1 to the time t2, there follows a neutral phase in which the heat accumulator is closed off and neither charging nor discharging takes place. At the time t2, the temperature at the outlet of the heat accumulator has fallen below the coolant temperature by 10 K, for which reason a charging state is started at the time t2. Then, until the time t3, the heat accumulator is charged until the temperature at the outlet of the heat accumulator has come to within 5° C. of the temperature of the coolant. Subsequently, from the time t3 to the time t4, the neutral phase is implemented, which means that the heat accumulator is again neither charged nor discharged.

From the time t4 to the time t5, a charging phase takes place again. In the overrun operation phase from the time t6 to the time t7, no discharging takes place, because in this exemplary embodiment, it is defined that only a single discharge may take place while the ignition is activated, and in this exemplary embodiment this was the discharge from the time t0 to the time t1, for which reason no charging or discharging takes place between the time t5 and the time t8, and charging takes place again from the time t8 to the time t9 because, at the time t8, the coolant temperature at the outlet of the heat accumulator is again 10 K lower than the coolant temperature, wherein at the time t9, the temperature of the coolant at the outlet of the heat accumulator is only 5° C. below the coolant temperature in the internal combustion engine, for which reason the charging is ended again.

As can be seen, charging states occur when the coolant temperature at the outlet of the heat accumulator lies below the coolant temperature in the internal combustion engine by a predefined value, and the charging state is ended when a second threshold value for the coolant temperature at the outlet of the heat accumulator is exceeded, wherein in the exemplary embodiment of FIG. 3, the respective values of 10 K and 5 K below the coolant temperature in the internal combustion engine are used for this purpose. In other exemplary embodiments, other temperature windows may also be defined, such as for example 8 K and 4 K and, respectively, 6 K and 3 K in each case for the start of charging and, respectively, the end of charging.

Discharging takes place, as per FIG. 3, when the coolant temperature at the outlet of the heat accumulator is higher than the coolant temperature in the internal combustion engine, and the discharging is ended when the coolant temperature at the outlet of the heat accumulator is higher than the coolant temperature in the internal combustion engine only by less than a predefinable value. In this case, the discharging of the heat accumulator is ended.

Figure 4:
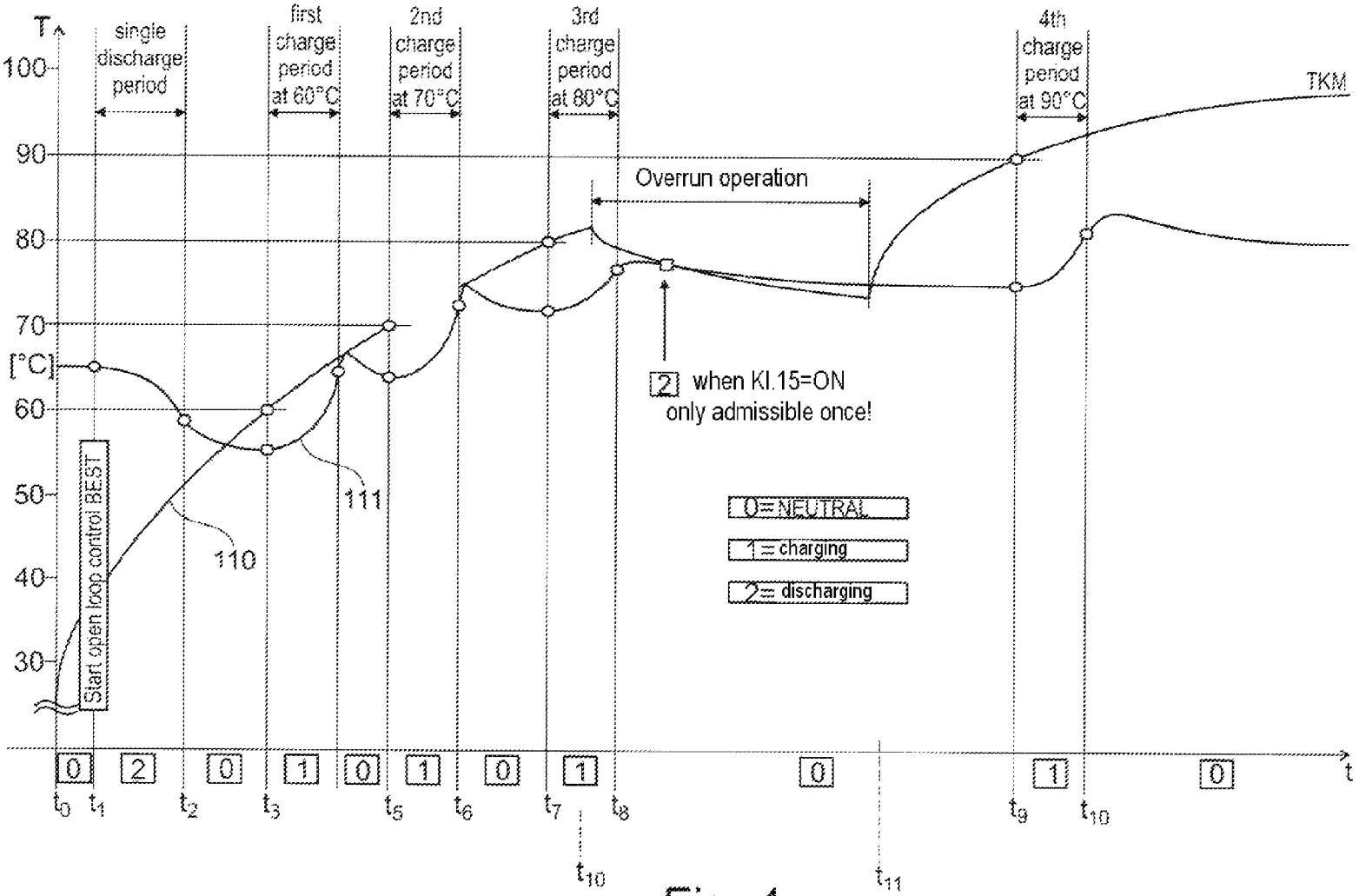
FIG. 4 shows a diagram.

FIG. 4 shows a diagram for an exemplary embodiment of an open-loop control regime for the charging and discharging of the heat accumulator, wherein again the temperature T is plotted in a diagram as a function of the time t. Again, the coolant temperature 110 in the internal combustion engine is plotted as a function of the time, wherein furthermore, the coolant temperature at the outlet of the heat accumulator 111 is plotted as a second curve. From the time t0 to the time t1, a neutral phase takes place, that is to say no charging or discharging of the heat accumulator takes place. At the time t1, the open-loop control of the charging or discharging of the heat accumulator is started. Since, at the time t1, the temperature of the coolant at the heat accumulator outlet is considerably higher than the temperature of the coolant in the internal combustion engine, a discharge period takes place. In said discharge period, the heat accumulator is discharged into the cooling circuit over a predefinable time period. At the end of the time period t1 to t2, the temperature of the coolant at the outlet of the heat accumulator is only slightly higher than the temperature of the coolant in the internal combustion engine, such that a neutral phase takes place from time t2 to t3. At the time t3, the coolant temperature at the outlet of the heat accumulator is lower than the coolant temperature in the internal combustion engine, and the coolant temperature in the internal combustion engine has reached a threshold value of 60° C., such that subsequently, from t3 to t4, a charging process is open-loop-controlled. The charging process takes place from t3 to t4 and lasts for a predefined time period Δt, such that at the end of the charging process at t4, the coolant temperature at the outlet of the heat accumulator is only slightly lower than the temperature of the coolant in the internal combustion engine. Subsequently, from t4 to t5, a neutral phase takes place again, and a charging phase takes place again from t5 to t6 because the temperature of the coolant in the internal combustion engine has reached 70° C.

From t5 to t6, the temperature of the coolant at the heat accumulator outlet rises again. Subsequently, from t6 to t7, a neutral phase takes place again without charging or discharging of the heat accumulator, and charging of the heat accumulator takes place again at t7 because the temperature of the coolant in the internal combustion engine has exceeded 80° C. The charging of the heat accumulator takes place from t7 to t8 and the temperature of the coolant at the heat accumulator outlet increases again. A neutral phase takes place from t8 to t9 because the coolant temperature decreases owing to the overrun operation from t10 to t11 and only increases again thereafter from t11 to t9, and at t9, a threshold temperature of 90° C. is reached, such that charging of the heat accumulator takes place again from t9 to t10, and a neutral phase is assumed after t10.

As an alternative to the pump 4, it is also possible for an auxiliary water pump to be provided in the line 18, which auxiliary water pump serves for the admission and/or discharging of the coolant into or out of the heat accumulator.

In the case of a closed-loop-controlled embodiment by means of the temperature difference of the coolant of the internal combustion engine with respect to the temperature of the coolant of the heat accumulator, use may be made of a hysteresis for the inflow state and for the discharging process.

In a preferred embodiment, a single discharge of the heat accumulator while the ignition is activated, that is to say during one driving cycle, may be realized. This has the effect that coolant with a maximum coolant temperature can be stored.

Discharging and storing multiple times is however alternatively also possible if, for example in the event of a long period of travel in the overrun mode, the coolant temperature falls more than a predefinable value of for example 10 K in relation to the highest coolant temperature hitherto attained.

It is also possible in a further exemplary embodiment for storage of cold coolant to take place, said cold coolant being discharged by being provided in the event of an increased power demand of the internal combustion engine. This is advantageous in particular in internal combustion engines with charge air cooled by means of coolant, because it increases the cooling capacity.

The invention claimed is:

1. A method for operating a circuit,
having a heat accumulator,
having a coolant circuit,
having a heat accumulator in a line of the circuit and
having at least one valve and one pump,
wherein, when the at least one valve is open, a coolant from the cooling circuit charges the heat accumulator by way of the at least one pump, or coolant discharges from the heat accumulator into the coolant circuit,
wherein the charging or discharging of the heat accumulator takes place in an open-loop-controlled or closed-loop-controlled manner as a function of a temperature of the coolant in the circuit or a temperature of the coolant in the heat accumulator or a temperature difference therebetween,
wherein charging of the heat accumulator takes place when the temperature of the coolant in the cooling circuit exceeds the temperature of the coolant in the heat accumulator by a first predefinable value or the temperature of the coolant has reached a first predefinable value,
wherein discharging of the heat accumulator into the cooling circuit takes place when the temperature of the coolant in the heat accumulator exceeds the temperature of the coolant in the cooling circuit by a first predefinable value,
wherein the temperature of the first predefinable value increases from one charging process to the next.

2. The method according to claim 1, wherein the temperature of the coolant in the circuit is a coolant temperature in an internal combustion engine or at the inlet or outlet of the internal combustion engine.

3. The method according to claim 1, wherein the temperature of the coolant in the heat accumulator is a coolant temperature in the heat accumulator or at the inlet or outlet of the heat accumulator.

4. The method according to claim 1, wherein discharging of the heat accumulator into the cooling circuit takes place in a time-dependent manner in a predefinable chronological sequence, or in a manner dependent on the most recent charging process or on the coolant temperature in the circuit.

5. The method according to claim 1, wherein the discharging of the heat accumulator into the cooling circuit is ended when the temperature of the coolant in the heat accumulator exceeds the temperature of the coolant in the cooling circuit by less than a second predefinable value.

6. The method according to claim 1, wherein discharging of the heat accumulator takes place only once or multiple times per driving cycle.

7. The method according to claim 1, wherein the temperature of the predefinable value increases from one charging process to the next wherein the value increases by 5 K or 10 K after each charging process.

8. The method according to claim 1, wherein the charging of the heat accumulator from the cooling circuit is ended when the temperature of the coolant in the cooling circuit exceeds the temperature of the coolant in the heat accumulator by less than a second predefinable value or a predefinable time duration for the charging process has expired.

9. The method according to claim 1, wherein charging of the heat accumulator takes place only when the coolant temperature in the cooling circuit has exceeded a predefinable threshold value.

10. The method according to claim 1, wherein charging of the heat accumulator takes place as a function of the temperature difference of the coolant temperature in the cooling circuit minus the temperature of the coolant in the heat accumulator or as a function of the absolute value of the temperature of the coolant in the cooling circuit, wherein the charging also takes place multiple times per driving cycle.

11. The method according to claim 1, wherein no discharging of the heat accumulator takes place in overrun operation phases of the internal combustion engine of the vehicle.

12. A method for operating a circuit, having a heat accumulator, having a coolant circuit, having a heat accumulator in a line of the circuit and having at least one valve and one pump, wherein, when the at least one valve is open, a coolant from the cooling circuit charges the heat accumulator by way of the at least one pump, or coolant from the heat accumulator into the coolant circuit, wherein the charging or discharging of the heat accumulator takes place in an open-loop-controlled or closed-loop-controlled manner as a function selected from the group consisting of a temperature of the coolant in the circuit, a temperature of the coolant in the heat accumulator, a temperature difference therebetween, and any combination thereof, wherein charging of the heat accumulator takes place when the temperature of the coolant in the cooling circuit exceeds the temperature of the coolant in the heat accumulator by a first redefinable value or the temperature of the coolant has reached a first redefinable value, wherein discharging of the heat accumulator into the cooling circuit takes place when the temperature of the coolant in the heat accumulator exceeds the temperature of the coolant in the cooling circuit by a first predefinable value, wherein the temperature of a predefinable value increases from one charging process to the next, wherein the value increases by 5 K or 10 K after each charging process.

13. The method according to claim 12, wherein no discharging of the heat accumulator takes place in overrun operation phases of the internal combustion engine of the vehicle.

14. The method according to claim 12, wherein the temperature of the coolant in the circuit is a coolant temperature in an internal combustion engine or at the inlet or outlet of the internal combustion engine.

* * * * *